US008631835B2

(12) United States Patent
Pouyat et al.

(10) Patent No.: US 8,631,835 B2
(45) Date of Patent: Jan. 21, 2014

(54) SYSTEM FOR INJECTING MORTAR INTO A CONTAINER

(75) Inventors: Dominique Pouyat, Aix en Provence (FR); Eric Blanchard, Bourg Saint Andeol (FR); Pierre Brovelli, La Garde Adhemar (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 528 days.

(21) Appl. No.: 12/999,743

(22) PCT Filed: Jun. 23, 2009

(86) PCT No.: PCT/FR2009/000755

§ 371 (c)(1),
(2), (4) Date: Dec. 17, 2010

(87) PCT Pub. No.: WO2010/004113

PCT Pub. Date: Jan. 14, 2010

(65) Prior Publication Data

US 2011/0099953 A1 May 5, 2011

(30) Foreign Application Priority Data

Jun. 26, 2008 (FR) ..... 08 03580

(51) Int. Cl.
*G21F 9/00* (2006.01)

(52) U.S. Cl.
USPC ..... 141/1; 141/83; 141/95; 141/198; 141/290; 588/2; 976/DIG. 385; 976/DIG. 394

(58) Field of Classification Search
USPC ..... 141/1, 11–12, 74, 80, 83, 93, 94–95, 141/192, 198, 290; 588/2; 976/DIG. 385, 976/DIG. 394
See application file for complete search history.

(56) References Cited

U.S. PATENT DOCUMENTS 3,704,865 A * 12/1972 Kharitonov et al. ..... 366/77
3,966,175 A * 6/1976 Stock et al. ..... 366/141

(Continued)

FOREIGN PATENT DOCUMENTS

DE 25 36 699 A1 4/1976
EP 0 111 221 A 6/1984

(Continued)

OTHER PUBLICATIONS

English abstract of RU 2 315 380 C1.

*Primary Examiner* — Timothy L Maust
*Assistant Examiner* — Nicolas A Arnett
(74) *Attorney, Agent, or Firm* — Ladas & Parry LLP

(57) ABSTRACT

A method of injecting mortar into a container fastened to a first tank and to a second tank, the first tank communicating with the container via a first orifice and the second tank communicating with the container by a second orifice, the method comprising the following operations: a continuous circulation of a first stream of mortar is made to flow in a circulation loop; during the continuous circulation, a second stream of mortar is drawn off from the circulation loop, the second stream being smaller than the first stream of mortar; the second stream of mortar is injected into the container, ensuring that there is dynamic confinement of the gaseous effluents; and the appearance of mortar in the second tank is monitored and, when this appearance is detected, the removal of mortar from the circulation loop is brought to an end.

18 Claims, 2 Drawing Sheets

(56) References Cited

U.S. PATENT DOCUMENTS

| | | | | | |
|---|---|---|---|---|---|
| 4,291,536 | A | * | 9/1981 | Girard | 60/644.1 |
| 4,379,081 | A | * | 4/1983 | Rootham et al. | 588/3 |
| 4,460,499 | A | * | 7/1984 | Boden | 588/5 |
| 4,560,501 | A | * | 12/1985 | Minami et al. | 422/131 |
| 4,636,363 | A | | 1/1987 | Kratz et al. | |
| 4,710,318 | A | * | 12/1987 | Horiuchi et al. | 588/3 |
| 4,793,947 | A | * | 12/1988 | Izumida et al. | 588/3 |
| 4,851,155 | A | * | 7/1989 | Kanagawa et al. | 422/138 |
| 5,045,241 | A | * | 9/1991 | Kuriyama et al. | 588/2 |
| 5,140,165 | A | * | 8/1992 | Kiuchi et al. | 250/506.1 |
| 5,143,654 | A | * | 9/1992 | Kikuchi et al. | 588/4 |
| 5,256,338 | A | | 10/1993 | Nishi et al. | |
| 5,481,061 | A | * | 1/1996 | Funabashi et al. | 588/4 |
| 5,489,737 | A | | 2/1996 | Baba et al. | |

FOREIGN PATENT DOCUMENTS

| | | | |
|---|---|---|---|
| FR | 2 605 788 | A | 4/1988 |
| GB | 1510494 | A | 5/1978 |
| GB | 2196548 | A | 5/1988 |
| RU | 2 315 380 | C1 | 1/2008 |

* cited by examiner

SYSTEM FOR INJECTING MORTAR INTO A CONTAINER

TECHNICAL FIELD

The present invention relates to a system for injecting mortar into a container.

The invention relates in particular to introducing mortar into a drum containing harmful waste, in particular radioactive waste resulting from operations for conditioning material during the fabrication of mixed oxide (MOX) fuel $(U,Pu)O_2$, and operations of decontaminating or dismantling a glovebox.

STATE OF THE ART

Patents FR 2 605 788 and U.S. Pat. No. 5,246,287 describe an apparatus for introducing mortar into a drum containing radioactive waste.

The apparatus comprises a receiver fitted with a mixer and into which water and the materials necessary for making a slurry are introduced. The apparatus includes a pump extracting the slurry from the receiver and delivering the slurry to the drum via ducts for conveying the slurry and including a three-port valve.

A compressed air duct opens out into the valve, and a return duct connects the valve to the receiver. The quantity of slurry delivered by the pump is controlled by load cells fitted to the receiver, and excess slurry is sent to the receiver via the return duct. The compressed air serves to facilitate injecting the slurry into the drum.

A drawback of that slurry injection method is that the compressed air used for injection is subjected to contamination and must subsequently be decontaminated.

Furthermore, although that method is adapted to injecting a predetermined quantity of slurry into a drum containing waste, which drum must therefore present a volume that is known accurately, it is on the contrary ill-adapted to circumstances in which the volume of waste contained in the drum is poorly known.

Another drawback of that method is that it does not make it possible, once the filling of the drum has been terminated, to be certain that no contaminated slurry or air has migrated to the three-port valve and to the apparatus as a whole.

SUMMARY OF THE INVENTION

An object of the invention is to propose a device and a method for injecting mortar into a container containing waste, enabling the container to be filled accurately without knowing exactly the volume of the waste, by providing dynamic confinement.

An object of the invention is to propose a device and a method for injecting mortar into a container containing waste, minimizing the quantities of the materials used (in particular air and mortar) that are subjected to contamination and that consequently need to be subjected to subsequent decontamination.

An object of the invention is to propose a device and a method for injecting mortar into a container containing waste, making it possible to be certain, once filling of the container has terminated, that no materials that might be contaminated (in particular air and mortar) migrate to the device as a whole.

An object of the invention is to propose a device and a method for injecting mortar into a container containing waste, facilitating emptying and cleaning of the ducts for conveying mortar.

An object of the invention is to propose a device and a method for injecting mortar into a container containing waste, enabling the container to be filled accurately so as to be sure that the empty space at the top thereof is of substantially zero volume.

An object of the invention is to propose a device and a method for injecting mortar into a container containing waste, improving and/or remedying, at least in part, the shortcomings and drawbacks of prior art devices and methods for injecting mortar.

In an aspect of the invention, there is provided a method of injecting mortar into a container containing waste, the method comprising the following operations:

- causing a first stream of mortar to circulate continuously in a circulation loop;
- during the continuous circulation, extracting from the circulation loop a second stream of mortar that is smaller than the first stream of mortar; and
- introducing the second stream of mortar into the container containing waste.

Thus, by extracting only a fraction of the flow of mortar circulating in the loop, any risk of introducing air into the mortar for injection is avoided.

The invention also provides a device for injecting mortar into a container containing waste, which device comprises:

- a mortar circulation loop comprising a mortar storage receiver, a mortar transfer pump connected to the storage receiver, an outlet duct for conveying the mortar leaving the pump, and a return duct for conveying mortar to the storage receiver; and
- an injection duct extending the outlet duct.

According to a characteristic of the mortar injection device of the invention, the circulation loop includes an extractor member connecting together the outlet duct, the return duct, and the injection duct, and the injection duct and the loop are isolated by a valve having a single passageway; this isolation valve is placed at the inlet to the injection duct, and the absence of a valve, other than an optional mortar flow regulator, in the outlet and return ducts of the loop makes it possible to ensure a continuous flow of mortar, the extractor member serving to extract a fraction of the mortar stream circulating in the loop and to introduce it into the injection duct.

Preferably, the extractor member is in the form of a Y junction or coupling presenting three duct portions: a first duct portion and a second duct portion connected respectively to the outlet duct and to the return duct; and the third duct portion is placed (connected) tangentially to the first duct portion and is connected to the injection duct. For this purpose, at least one of the three duct portions is curved.

In an embodiment, the section of the first duct portion is substantially the same as the section of the second duct portion, while the section of the third duct portion is less than the section of the first and second duct portions.

In other words, and according to another aspect of the invention, a method is provided of injecting mortar into a container containing waste, the method comprising the following operations:

- mortar is caused to circulate under pressure in a circulation loop;
- at an extraction point of the circulation loop, mortar is extracted at a pressure that is sufficient to compensate for the head loss resulting from conveying the (extracted) mortar via an injection duct connecting the extraction point to the container; and
- the mortar extracted from the loop is introduced into the container containing waste in such a manner as to avoid introducing any propellant (solid, liquid, gaseous, or other) into the injection duct—and consequently into the container containing waste.

To this end, in a device of the invention, the lengths and the diameters of the return duct and of the injection duct, and the through diameters of the members, such as valves, located in said ducts are selected in such a manner that the head loss in the injection duct, corrected for variations of position between the inlet and the outlet of the injection duct, is close to or less than the head loss in the return duct, corrected for variations in position between the inlet and the outlet of the return duct.

Furthermore, and also for this purpose, the valve(s) fitted to the injection duct are selected to give rise to low head loss; the valve(s) is/are preferably selected from "full flow" valves, in particular from sleeve valves and plug valves.

Preferably, the altitude position of the inlet orifice of the injection duct is higher than the altitude position of the outlet orifice of said duct, so as to encourage the mortar to flow under gravity along the duct.

In other words, in yet another aspect of the invention, there is provided a method of injecting mortar into a container containing waste and including a first orifice and a second orifice, a first vessel secured to the container communicating with the container via the first orifice, and a second vessel secured to the container communicating with the container via the second orifice, the method comprising the following operations:

extracting mortar from the mortar circulation loop;

introducing the mortar extracted from the mortar circulation loop into the container;

vibrating the container to facilitate flow inside it; and monitoring the appearance of mortar in the second vessel, and when said appearance is detected, ceasing to extract mortar from the circulation loop.

It is thus possible to introduce into the waste container the quantity of mortar that is strictly necessary for filling it without there being any need to know this quantity in advance.

To this end, in a device of the invention, the altitude positions of the first and second vessels are preferably similar (substantially identical); the respective capacities of these vessels may also be substantially identical.

The device of the invention also preferably includes a sensor sensitive to the appearance of mortar in the second vessel, such as a radar sensor.

In a preferred embodiment, each of the vessels presents an upwardly-flared shape, in particular an upwardly-flared frustoconical shape in order to facilitate subsequent unmolding.

Preferably, after mortar has ceased to be extracted from the loop, the mortar contained in an injection duct connecting the mortar circulation loop to the first vessel (and to the container) is expelled into the first vessel so that it is subsequently possible to clean the injection duct prior to filling another waste container.

To this end, in a device of the invention, the sum of the capacities, or the useful volume, of the first and second vessels is preferably not less than the capacity, or volume, of the injection duct.

Also preferably, the mortar contained in the injection duct is expelled by introducing compressed air into the injection duct and then, after connecting the injection duct to a rinsing pot, causing a rinsing liquid such as water to flow in the duct so as to entrain and remove any mortar residue that might have collected on the walls of the injection duct.

Also preferably, the second vessel is connected to a circuit for extracting and filtering air and the contaminated air that is expelled from the container while mortar is being introduced therein is extracted from the second vessel.

To this end, a device of the invention may include a receptacle for collecting the rinsing liquid, a collector of shape adapted to the shape of the second vessel for collecting the gaseous effluents, essentially air, leaving the vessel, and a duct connected to the collector to deliver the effluents to a gaseous effluent decontamination circuit.

After the mortar has dried, and shrunk while drying, it is possible to separate the two vessels and the "lumps" of mortar they contain from the waste container, and then to close both orifices of the container with stoppers.

Other aspects, characteristics, and advantages of the invention appear from the following description given with reference to the accompanying drawings that show preferred embodiments of the invention having no limiting character.

DETAILED DESCRIPTION OF THE INVENTION

To ensure the present application is clear, the terms "receiver" and "hopper" are used to designate a container adapted to contain a sufficient supply of mortar to fill the space left empty by the waste placed in a waste container.

For the same purpose, the terms "vessel" and "cone" are used in the present application to designate a container suitable for containing surplus mortar delivered to the waste container.

Also for the same purpose, the terms "receptacle" and "capacity" are used in the present application to designate a container adapted to contain effluents resulting from cleaning the mortar injection system.

Consequently, and unless stated explicitly or implicitly to the contrary, the term "container" is used in the present application solely to designate the container that contains waste.

Figure 1:
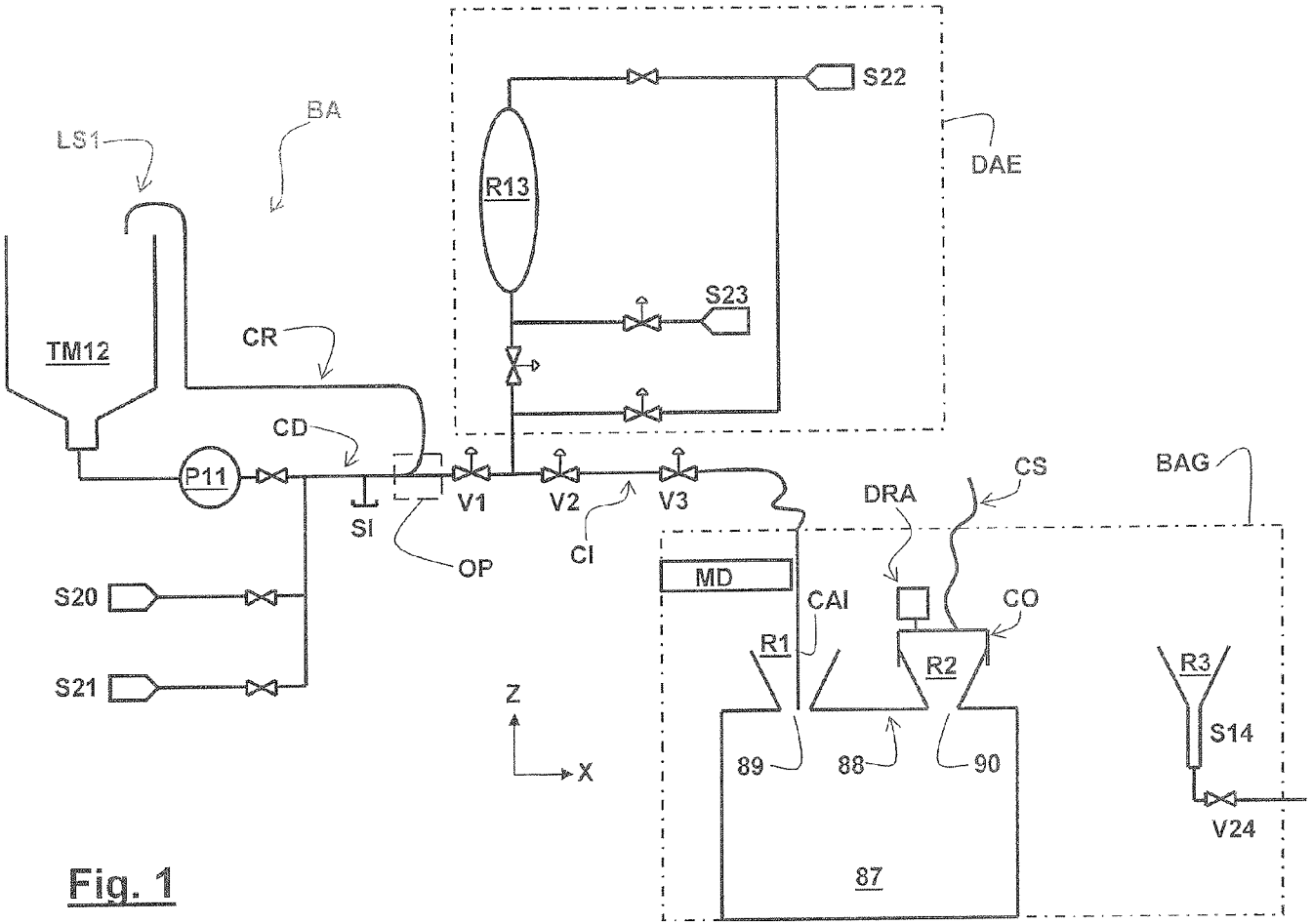
FIG. 1 is a diagram of a device of the invention.

With reference to FIG. 1 in particular, the mortar injection system is intended to ensure that waste contained in a container 87 is locked in place.

The mortar injection device comprises:

a mortar circulation loop BA comprising a mortar storage receiver TM12, a positive displacement pump P11 for transferring mortar, which pump is connected to the storage receiver, an outlet duct CD for transporting the mortar from the outlet of the pump, and a return duct CR for transporting mortar back to the storage receiver; and an injection duct CI extending the outlet duct.

The circulation loop includes an extractor member OP connecting the outlet duct, the return duct, and the injection duct together.

The injection duct and the loop are isolated by a valve V1 having a single passageway and located at the inlet to the injection duct.

The mortar for injection into the container is prepared and then stored temporarily in a hopper TM12 prior to being taken by pipework to a glovebox BAG in which the container 87 is located.

The device has an injection duct CI fitted with a system of three valves V1, V2, and V3 adapted to injection and to rinsing the duct. The valves V1, V2, and V3 are sleeve valves or plug valves with full-flow.

The injection duct terminates in an injection pipe CAI located in the glovebox and supported by a mechanism MD for moving the injection pipe, which mechanism is operated by an operator.

In order to fill the container 87, the injection pipe CAI is inserted into a first vessel R1 referred to as a "filler cone" and fastened to a top wall 88 of the contain 87, which top wall is pierced by a first orifice 89 used for filling.

Detecting when the container has been filled with mortar is performed via a second vessel R2, referred to as a "vent cone", that is also fastened to the top wall 88 of the container that is pierced by a second orifice 90 serving as a vent and overflow.

The first and second vessels R1 and R2 are secured to the container in register with the orifices 89, 90 provided through its wall 88, with the height positions of the first and second vessels being similar.

The container 87 is set into vibration while the mortar is flowing in.

The mortar is constituted by a mixture of sand, cement, and water, possibly having added thereto one or more additives, in particular a plasticizing agent.

The mortar may present a density close to 2.25 kilograms per cubic decimeter (kg/dm$^3$), fluidity measured using a Marsh cone close to 200 centipoise (cP) to 500 cP, and a duration of utilization before setting of no more than three hours.

The mortar is prepared in a mixer (not shown) and then placed in the buffer hopper TM12 that presents a working volume that is sufficient to fill a container 87 that contains little waste.

The mortar injection installation comprises three portions:

- a feed loop BA between the hopper TM12 and a member OP for extracting mortar into the loop;
- an injection duct CI between the member OP for extracting mortar and the glovebox BAG; and
- a device DAE for introducing air and water into the injection duct.

The mortar injection installation serves to perform the following functions:

- causing the mortar to circulate around the loop BA and to flow along the duct CI leading to the cementing glovebox BAG where the container 87 for filling is located;
- filling one or more containers 87 per day, while guaranteeing the quality of the mortar injected into the containers 87;
- being capable of being emptied and rinsed simply, limiting the quantity of waste that is generated;
- avoiding mortar overflowing in the glovebox; and
- guaranteeing compliance with safety requirements associated with the danger level of the waste.

The safety requirements are as follows:

- ensuring confinement between the roof of the container 87 and the ambient atmosphere of the treatment premises housing the device;
- ensuring confinement between the ambient atmosphere in the cementing glovebox BAG and the ambient atmosphere in the treatment premises;
- ensuring confinement relative to the outside; and
- recovering the suspect waste generated under confinement to avoid any dispersion in the treatment premises.

For this purpose, it is useful to take account of the respective dimensions of the point OP where the mortar is extracted from the loop and the top 88 of the container, and the diameter and the length of the mortar injection duct, so that, at the desired injection flow rate, the head of mortar and the in-line head losses are in balance and the mortar can flow to the outlet of the injection duct at a pressure that is substantially zero, without said duct becoming emptied. Thus, for example, it is possible to determine the mean diameter of the injection duct as a function of these dimensions, length, and flow rate.

Choosing a larger diameter could lead to the downwardly sloping portion of the duct CI being emptied under gravity, thereby putting the ambient atmosphere of the glovebox into communication with the pipework outside the confined zone, and also leading to a greater volume of contaminated mortar (when emptying and rinsing the injection duct).

Choosing a smaller diameter would increase the risks of the duct CI becoming blocked and that would require a higher pressure for the mortar in order to cause it to flow.

For the injection pipe, it is preferable to select a diameter that is adapted to the fluidity and the viscosity of the composition and to the slope between the extraction point and the high level of the container.

The mortar is put under pressure and caused to circulate around the loop BA by a peristaltic pump P11, and it is transferred to the container by the injection duct CI that is connected to the loop BA via the member OP.

Providing the mortar flows continuously in the feed loop (and thus providing the flow rate in the loop is greater than the injected flow rate), this makes it possible to have a loop that is filled and under moderate pressure at the level of the branching point OP of the injection duct; this makes it possible to restrict the volume of contaminated/suspect mortar to the volume of the injection duct, with the mortar that is present in the feed loop constituting waste that is conventional (i.e. non-suspect).

The flow rate of the mortar flowing in the return duct of the loop BA may for example be about 10% of the flow rate of the mortar passing through the pump P11, with 90% of that flow rate that passes through the pump being extracted from the loop and injected into the container.

The pressure of the mortar in the extractor member may for example be adjusted to a value of the order of about 0.5 bar to about 1 bar.

The height dimension of the inlet orifice to the injection duct, i.e. of the member OP, is higher than the height dimension of the outlet orifice of said duct, i.e. of the pipe CAI, so as to encourage the mortar to flow in said duct under gravity.

The injection duct preferably presents a downward slope so as to avoid the presence of any bottom point that might retain mortar or rinsing water or moisture.

The confinement between the feed loop together with the rinsing device relative to the injection duct is provided by a motor-driven isolating valve V2; the confinement of the feed loop is provided by the two motor-driven isolation valves V1 and V2.

The valves may be of the sleeve type that withstand abrasion (full flow when the valve is open, closure by flattening the membrane), with pneumatic motor drive.

The duct segments may be made of stainless steel; flexible duct portions may be provided to connect both the peristaltic pump and the return duct to the buffer hopper TM12, and also within the glovebox to connect the injection pipe to the injection duct, so as to allow said pipe to be moved and avoid transmitting the vibration of the container 87 to the glovebox.

Two cones R1, R2 are put into place on the filler and vent orifices 89 and 90 of the container 87. The volume of each of these cones is not less than half the volume of the injection duct; the volume of said duct between the valve V1 and the outlet orifice of the pipe CAI may be of the order of one or several cubic decimeters (dm$^3$).

The injection pipe is supported by a bracket MD enabling the pipe to be moved in translation along axes x and z, and also in rotation about the axis z.

The end of the pipe includes a system that provides sealing when the pipe comes to bear against the cone R1.

The vent cone R2 is fitted with a radar detector DRA for detecting the presence of mortar in the cone. This cone is connected by a collector CO and a flexible hose CS to a system for extracting air from the cementing glovebox BAG so as to avoid contaminating the inside of the glovebox with air that has passed through the container 87.

Mortar injection is stopped as a result of the presence of mortar in the vent cone being detected by the radar sensor; the feed loop is then isolated from the injection duct by closing the valve V1.

The feed loop is then emptied by expelling the mortar using compressed air delivered by the source S20. The mortar contained in the feed loop is recovered in the hopper TM12.

The flexible connection LS1 of the return duct of the feed loop is then connected to a tank for recovering rinsing water and the delivery from the mortar pump P11 is connected to the industrial waste water network. Water delivered by the source S21 is then introduced into the loop BA together with a sponge ball via an insertion lock S1, which ball is driven by the compressed air so as to clean the loop.

The part OP for extracting mortar to the injection duct, and having the valve V1 connected thereto, enables the portion of said valve that is upstream relative to the flow direction of the mortar to be rinsed.

The residue of mortar remaining in the injection duct (between the valve V1 and the injection pipe) is emptied into the mortar insertion cone R1 and into the container 87 by thrust from the compressed air delivered by the compressed air source S22 of the device DAE, or by a foam ball, after the pipe has been raised in order to vent the cones.

The volume of this "emptied-out" mortar is shared between the filler cone R1 and the vent cone R2.

The injection pipe is then moved and positioned by the mechanism MD over a third cone R3 connected to a capacity S14 situated in the glovebox BAG and serving to recover the water used for rinsing the injection portion. Emptying is performed by expelling the water coming from a diaphragm reservoir R13 put under air pressure by the source S22 and filled with water by the source S23.

On each occasion after the injection duct has been rinsed, the capacity S14 is emptied to a tank for suspect effluents via a duct provided with a valve V24.

Figure 2:
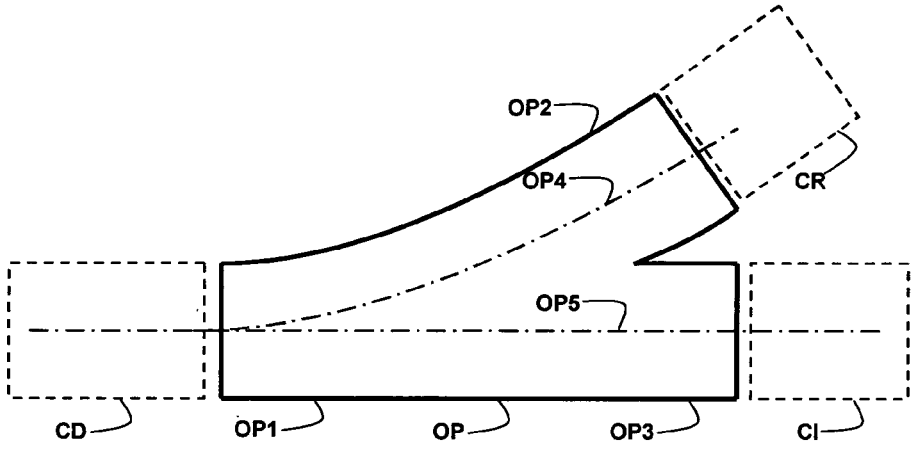
FIGS. 2 to 4 are diagrams showing three variant embodiments of an extractor member of a device of the invention.
Figure 3:
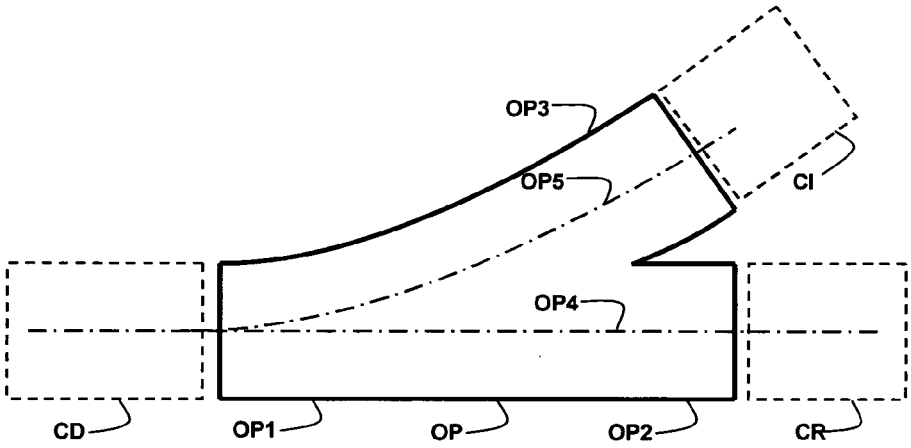
Figure 4:
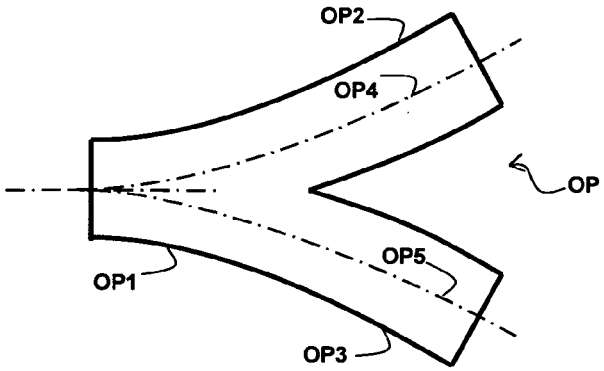

With reference to FIGS. 2 to 4 in particular, the extractor member OP is in the form of a Y junction or coupling presenting three duct portions: a first duct portion OP1 and a second duct portion OP2 are connected respectively to the outlet duct CD and to the return duct CR; the third duct portion OP3 is placed (connected) tangentially to the first duct portion and is connected to the injection duct CI.

In the embodiment shown in FIG. 2, the third duct portion OP3 extends along an axis OP5 that coincides with the axis of the first portion OP1, the second duct portion OP2 being curved.

In the embodiment shown in FIG. 3, the second duct portion OP2 extends along an axis OP4 that coincides with the axis of the first portion OP1, the third duct portion OP3 being curved.

In the embodiment of FIG. 4, both the second duct portion OP2 and the third duct portion OP3 are curved.

In the embodiments of FIGS. 2 to 4, all three duct portions OP1, OP2, and OP3 of the member OP present substantially identical sections (and/or diameters).

In a variant embodiment that is not shown, the section of the first duct portion may be substantially the same as the section of the second duct portion, with the section of the third duct portion being less than the section of the first and second duct portions.

The valve V3 serves to isolate the segment in the glovebox during maintenance operations or when changing pipework between the valves V1 and V3.

The invention claimed is:

1. A method of introducing mortar into a container secured to a first vessel and a second vessel, the first vessel communicating with the container via a first orifice, the second vessel communicating with the container via a second orifice, the method comprising the following operations:

causing a first stream of mortar to circulate continuously in a circulation loop;

during the continuous circulation, extracting a second mortar stream from the circulation loop, the second stream being smaller than the first mortar stream;

introducing the second mortar stream into the container; and monitoring the appearance of mortar in the second vessel, and when said appearance is detected, ceasing to extract mortar from the circulation loop.

2. A method according to claim 1, wherein, after ceasing to extract mortar from the loop, the mortar contained in an injection duct connecting the mortar circulation loop to the first vessel and to the container is expelled into the first vessel so that it is subsequently possible to clean the injection pipe, prior to filling another container.

3. A method according to claim 2, wherein the mortar contained in the injection duct is expelled by introducing compressed air or a foam ball into the injection duct and then causing a rinsing liquid to flow in said duct in order to drive and remove mortar residue that might collect on the walls of the injection duct.

4. A method according to claim 1, wherein the second vessel is connected to an air filter circuit and the contaminated air expelled from the container while mortar is being introduced therein is taken from the second vessel.

5. A method according to claim 1, wherein, after the mortar has dried, the container is separated from the two vessels and lumps of mortar contained therein, and the two orifices of the container are closed.

6. A method according to claim 1, wherein the second mortar stream is extracted at an extraction point of the circulation loop under pressure that is sufficient to compensate for the head loss that results from conveying the extracted mortar via an injection duct connecting the extraction point to the container, and without introducing a propellant into the injection duct.

7. A device for injecting mortar into a container, the device comprising:

a mortar circulation loop comprising a mortar storage receiver, a mortar transfer pump connected to the storage receiver, an outlet duct for conveying the mortar leaving the pump, and a return duct for conveying mortar to the storage receiver;

an injection duct extending the outlet duct;

first and second vessels secured to the container in register with orifices provided in the wall thereof, together with a sensor sensitive to the appearance of mortar in the second vessel; wherein:

the circulation loop includes an extractor member connecting together the outlet duct, the return duct, and the injection duct; and the injection duct and the loop are isolated by means of a single passageway valve placed at the inlet to the injection duct, the outlet and return ducts of the loop serving to ensure continuous circulation of the mortar, the extractor member enabling a fraction of the mortar stream flowing in the loop to be extracted and introduced into the injection device.

8. A device according to claim 7, wherein the extractor member is in the form of a Y junction or coupling presenting three duct portions: a first duct portion and a second duct portion connected respectively to the outlet duct and to the return duct; and a third duct portion connected tangentially to the first duct portion and connected to the injection duct, and wherein at least one of the three duct portions is curved.

9. A device according to claim 8, wherein the section of the first duct portion is the same as the section of the second duct portion, while the section of the third duct portion is less than the section of the first and second duct portions.

10. A device according to claim 7, wherein the lengths and the diameters of the return duct and of the injection duct, and the through diameters of the members located in said ducts are selected in such a manner that the head loss in the injection duct, corrected for variations of position between the inlet and the outlet of the injection duct, is close to or less than the head loss in the return duct, corrected for variations in position between the inlet and the outlet of the return duct.

11. A device according to claim 7, wherein a valve fitted to the injection duct is a full-flow valve.

12. A device according to claim 11 wherein said full flow valve is selected from sleeve valves and plug valves.

13. A device according to claim 7, wherein the respective capacities of the first and second vessels are identical.

14. A device according to claim 7, wherein the sensor sensitive to the appearance of mortar in the second vessel is a radar sensor.

15. A device according to claim 7, wherein each of the vessels presents an upwardly-flared shape, in particular an upwardly-flared frustoconical shape.

16. A device according to claim 7, wherein the sum of the capacities of the first and second vessels is not less than the capacity of the injection duct.

17. A device according to claim 7, including a receptacle suitable for collecting a liquid that has rinsed the injection duct.

18. A device according to claim 7, including a collector of shape matching the shape of the second vessel to collect the gaseous effluents leaving the vessel, and a duct connected to the collector to take the effluents to a decontamination circuit.

* * * * *